US010998114B2

(12) United States Patent
Ravindranathan et al.

(10) Patent No.: US 10,998,114 B2
(45) Date of Patent: May 4, 2021

(54) VARISTOR FOR HIGH TEMPERATURE APPLICATIONS

(71) Applicant: AVX Corporation, Fountain Inn, SC (US)

(72) Inventors: Palaniappan Ravindranathan, Simpsonville, SC (US); Marianne Berolini, Greenville, SC (US)

(73) Assignee: AVX Corporation, Fountain Inn, SC (US)

( * ) Notice: Subject to any disclaimer, the term of this patent is extended or adjusted under 35 U.S.C. 154(b) by 0 days.

(21) Appl. No.: 17/003,206

(22) Filed: Aug. 26, 2020

(65) Prior Publication Data

US 2020/0395152 A1 Dec. 17, 2020

Related U.S. Application Data

(63) Continuation of application No. 16/386,564, filed on Apr. 17, 2019, now Pat. No. 10,790,075.

(60) Provisional application No. 62/658,685, filed on Apr. 17, 2018.

(51) Int. Cl.
*H01C 7/112* (2006.01)
*H01C 7/102* (2006.01)

(52) U.S. Cl.
CPC ..... *H01C 7/112* (2013.01); *H01C 7/102* (2013.01)

(58) Field of Classification Search
CPC ..... H01C 7/102; H01C 7/112
See application file for complete search history.

(56) References Cited

U.S. PATENT DOCUMENTS

| | | | |
|---|---|---|---|
| 6,153,931 | A | 11/2000 | Niimi et al. |
| 6,346,496 | B2 | 2/2002 | Nabika et al. |
| 6,359,327 | B1 | 3/2002 | Niimi et al. |
| 6,362,521 | B1 | 3/2002 | Nabika et al. |
| 6,432,558 | B1 | 8/2002 | Nabika et al. |
| 6,472,074 | B2 | 10/2002 | Sugimoto |
| 6,522,238 | B2 | 2/2003 | Nagao et al. |
| 6,538,318 | B2 | 3/2003 | Nagareda et al. |
| 6,544,443 | B2 | 4/2003 | Niimi et al. |
| 6,617,955 | B2 | 9/2003 | Tanaka et al. |
| 7,075,408 | B2 | 7/2006 | Mihara et al. |
| 7,109,841 | B2 | 9/2006 | Haga et al. |
| 7,348,873 | B2 | 3/2008 | Niimi et al. |
| 7,649,437 | B2 | 1/2010 | Mihara et al. |
| 7,649,438 | B2 | 1/2010 | Ikeda et al. |
| 7,679,485 | B2 | 3/2010 | Kishimoto et al. |
| 7,764,161 | B2 | 7/2010 | Katsu et al. |

(Continued)

FOREIGN PATENT DOCUMENTS

| | | |
|---|---|---|
| JP | H05267005 | 10/1993 |
| KR | 1020160130653 | 11/2016 |

OTHER PUBLICATIONS

International Search Report and Written Opinion for PCT/US2019/027862 dated Aug. 8, 2019, 8 pages.

*Primary Examiner* — Kyung S Lee
(74) *Attorney, Agent, or Firm* — Dority & Manning, P.A.

(57) ABSTRACT

The present invention is directed to a varistor comprising a dielectric material comprising a sintered ceramic composed of zinc oxide grains and a grain boundary layer between the zinc oxide grains. The grain boundary layer contains a positive temperature coefficient thermistor material in an amount of less than 10 mol % based on the grain boundary layer.

21 Claims, 5 Drawing Sheets

(56) References Cited

U.S. PATENT DOCUMENTS

| | | | |
|---|---|---|---|
| 7,776,252 | B2 | 8/2010 | Mihara et al. |
| 7,830,240 | B2 | 11/2010 | Mihara et al. |
| 8,093,170 | B2 | 1/2012 | Katsu |
| 8,187,506 | B2 | 5/2012 | Kawase et al. |
| 8,228,161 | B2 | 7/2012 | Abe et al. |
| 8,284,013 | B2 | 10/2012 | Goto et al. |
| 8,289,125 | B2 | 10/2012 | Kishimoto et al. |
| 8,350,662 | B2 | 1/2013 | Abe et al. |
| 8,390,421 | B2 | 3/2013 | Kishimoto et al. |
| 8,488,291 | B2 | 7/2013 | Lien et al. |
| 8,624,703 | B2 | 1/2014 | Miura |
| 8,698,592 | B2 | 4/2014 | Katsu |
| 9,530,547 | B2 | 12/2016 | Aoto et al. |
| 10,790,075 | B2 * | 9/2020 | Ravindranathan ..... H01C 7/112 |
| 2007/0182522 | A1 | 8/2007 | Chang |
| 2009/0096569 | A1 | 4/2009 | Choi et al. |
| 2010/0117271 | A1 | 5/2010 | Lien et al. |
| 2012/0057265 | A1 | 3/2012 | Lien et al. |
| 2012/0135563 | A1 | 5/2012 | Lien et al. |
| 2013/0011963 | A1 | 1/2013 | Lien et al. |
| 2013/0133183 | A1 | 5/2013 | Lien et al. |
| 2015/0145639 | A1 | 5/2015 | Fu et al. |
| 2016/0155546 | A1 | 6/2016 | Miura et al. |
| 2016/0379738 | A1 | 12/2016 | Okamoto et al. |

* cited by examiner

VARISTOR FOR HIGH TEMPERATURE APPLICATIONS

CROSS REFERENCE TO RELATED APPLICATIONS

The present application is a continuation application of U.S. patent application Ser. No. 16/386,564 having a filing date of Apr. 17, 2019, which claims filing benefit of United States Provisional Patent Application Serial No. 62/658,685 having a filing date of Apr. 17, 2018, both of which are incorporated herein by reference in their entirety.

BACKGROUND OF THE INVENTION

Multilayer ceramic devices, such as multilayer ceramic capacitors or varistors, are typically constructed with a plurality of stacked dielectric-electrode layers. During manufacture, the layers may often be pressed and formed into a vertically stacked structure. In general, varistors are voltage-dependent nonlinear resistors and have been used as surge absorbing elements, arresters, and voltage stabilizers. Varistors may be connected, for example, in parallel with sensitive electrical components. The non-linear resistance response of varistors is often characterized by a parameter known as the clamping voltage. For applied voltages less than the clamping voltage of a varistor, the varistor generally has very high resistance and thus, acts similar to an open circuit. When the varistor is exposed to voltages greater than the clamping voltage of the varistor, however, the resistance of the varistor is reduced, such that the varistor acts more similar to a short circuit, allowing a greater flow of current through the varistor. This non-linear response may be used to divert current surges away from sensitive electronic components to protect such components.

In general, varistors have a maximum operating temperature of up to about 125° C. However, with the rapid development of new electronics and communication products, there is a desire for varistors to have even higher maximum operating temperatures.

SUMMARY OF THE INVENTION

In accordance with one embodiment of the present invention, a varistor is disclosed. The varistor comprises a dielectric material comprising a sintered ceramic composed of zinc oxide grains and a grain boundary layer between the zinc oxide grains. The grain boundary layer contains a positive temperature coefficient thermistor material in an amount of less than 10 mol % based on the grain boundary layer.

In accordance with another embodiment of the present invention, a method for forming a varistors is disclosed. The varistor comprises a dielectric material comprising a sintered ceramic composed of zinc oxide grains and a grain boundary layer between the zinc oxide grains. The grain boundary layer contains a positive temperature coefficient thermistor material in an amount of less than 10 mol % based on the grain boundary layer. The method comprises forming the dielectric material by calcining a zinc oxide and then mixing the calcined zinc oxide with the positive temperature coefficient thermistor material.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
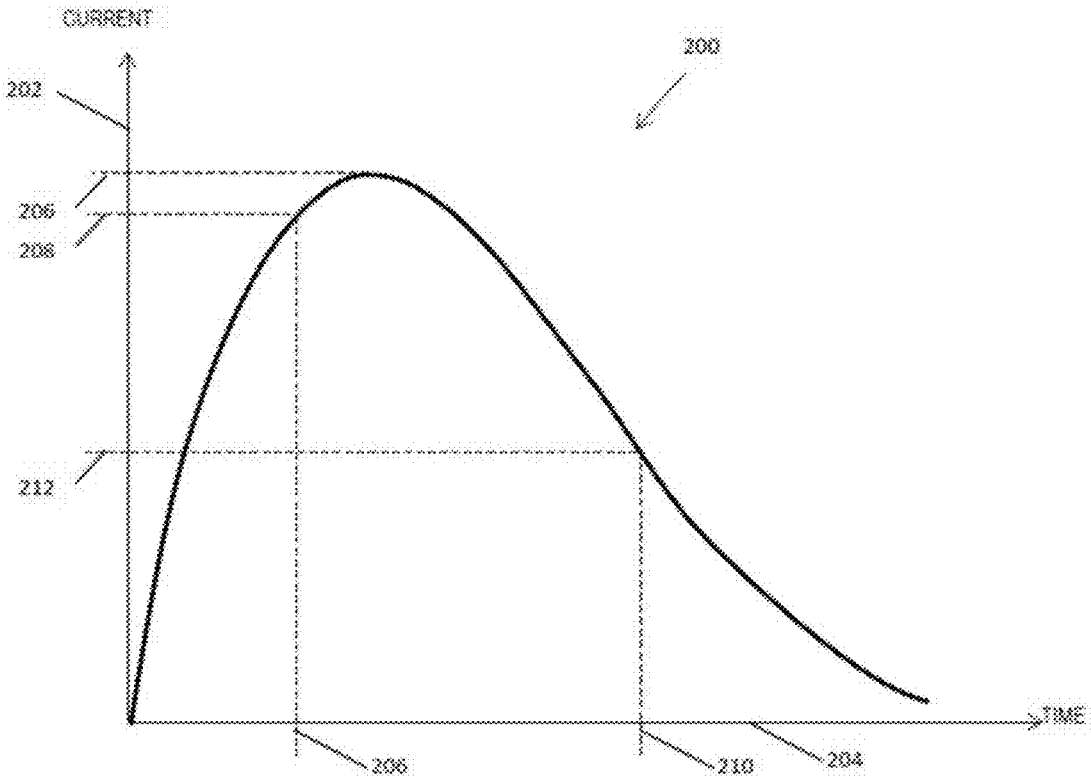
FIG. 1 illustrates an exemplary current pulse used to test various characteristics of the varistor in accordance with aspects of the present disclosure.

Repeat use of reference characters throughout the present specification and appended drawings is intended to represent same or analogous features, elements, or steps thereof.

DETAILED DESCRIPTION OF THE PREFERRED EMBODIMENTS

It is to be understood by one of ordinary skill in the art that the present discussion is a description of exemplary embodiments only, and is not intended as limiting the broader aspects of the present invention.

Generally speaking, the present invention is directed to a varistor. In particular, the present invention is directed to a varistor that is capable of operating at temperatures higher than other conventional varistors. For instance, unlike many varistors that are not capable of operating at temperatures greater than 125° C., the present inventors have discovered that the varistor disclosed herein can operate at temperatures of greater than 125° C., such as 150° C. or greater, such as 160° C. or greater. The varistor may have a maximum operating temperature of 300° C. or less, such as 250° C. or less, such as 200° C. or less, such as 190° C. or less, such as 180° C. or less.

In addition, the varistor may have a reduced or tighter clamping voltage. Generally, reducing the active resistance of a varistor may provide a reduced clamping voltage. Many factors may contribute to the active resistance of the varistor, including, for example, the properties of materials used to form the varistor and dimensions of the varistor and electrodes of the varistor. In addition to the above, however, the varistor may also exhibit other desirable characteristics, including a low capacitance (making the varistor especially suited for capacitance-sensitive circuits) and a low leakage current at a working voltage of the varistor.

Regarding the clamping voltage, the varistor may have a clamping voltage of about 200 volts or less, such as about 150 volts or less, such as about 100 volts or less, such as about 75 volts or less, such as about 50 volts or less, such as about 45 volts or less, such as about 40 volts or less, such as about 39 volts or less. The varistor may have a clamping voltage of about 1 volt or more, such as about 5 volts or more, such as about 10 volts or more, such as about 20 volts or more, such as about 30 volts or more, such as about 35 volts or more, such as about 50 volts or more, such as about 100 volts or more. Such clamping voltage may be realized at −55° C., such as at −25° C., such as at 0° C., such as at 25° C., such as at 50° C., such as at 75° C., such as at 100° C., such as at 125° C., such as at 150° C., such as at 175° C., such as at 200° C. For instance, such clamping voltage may be realized at a temperature of from 50° C. to 200° C., such as from 150° C. to 200° C., such as from 175° C. to 200° C.

Figure 2:
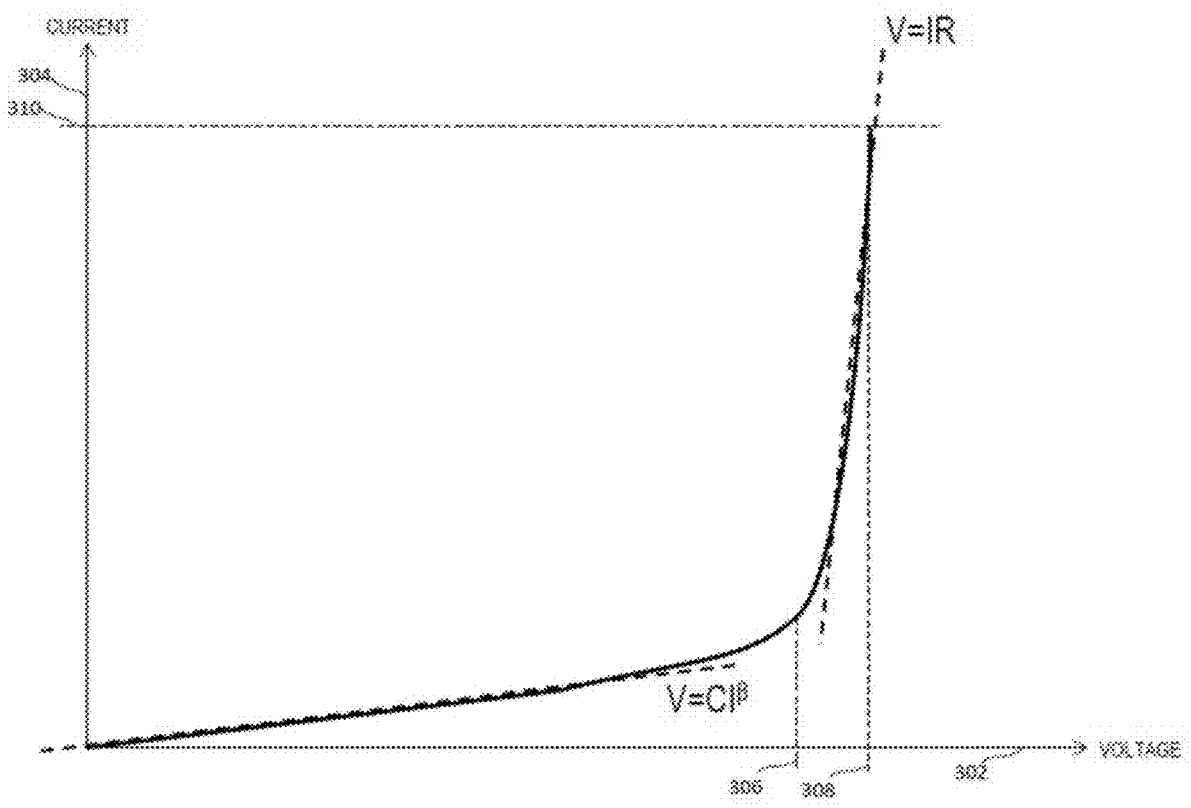
FIG. 2 illustrates current and voltage during an exemplary test of the varistor in accordance with aspects of the present disclosure.

It should be understood that the clamping voltage may be determined using methods generally employed in the art. For instance, the clamping voltage may be measured using a Frothingham Electronic Corporation FEC CV400 Unit. The varistor may be subjected to an 8/20 μs current wave, for example according to ANSI Standard C62.1. The current wave may have a peak current value of about 10 A or less, such as about 5 A or less, such as about 2.5 A or less, such as about 1 A or less, such as about 500 mA or less, such as about 100 mA or less, such as about 50 mA or less, such as about 10 mA or less, such as about 1 mA or less. The peak current value may be selected such that it causes the varistor to "clamp" the voltage, as explained in greater detail below. An exemplary current wave is illustrated in FIG. 1. The current (vertical axis 202) is plotted against time (horizontal axis 204). The current may increase to the peak current value 206 and then decay. The "rise" time period (illustrated by vertical dotted line 206) may be from the initiation of the current pulse (at t=0) to when the current reaches 90% (illustrated by horizontal dotted line 208) of the peak current value 206. The "rise" time may be 8 μs. The "decay time" (illustrated by vertical dotted line 210) may be from the initiation of the current pulse (at t=0) to 50% (illustrated by horizontal dotted line 212) of the peak current value 206. The "decay time" may be 20 μs. The clamping voltage measured as the maximum voltage across the varistor during the current wave. Referring to FIG. 2, the voltage across the varistor (horizontal axis 302) is plotted against the current through the varistor (vertical axis 304). As shown in FIG. 2, once the voltage exceeds the breakdown voltage 306, additional current flow through the varistor does not significantly increase the voltage across the varistor. In other words, the varistor "clamps" the voltage at approximately the clamping voltage 308. Thus, the clamping voltage 308 may be accurately measured as the maximum voltage measured across the varistor during the current wave. This remains true as long as the peak current value 310 is not so great that it damages the varistor.

In addition to a reduced or tighter clamping voltage, the varistor may have a low breakdown voltage. The breakdown voltage may be about 150 volts or less, such as about 100 volts or less, such as about 75 volts or less, such as about 50 volts or less, such as about 40 volts or less, such as about 35 volts or less, such as about 30 volts or less, such as about 27 volts or less. The varistor may have a breakdown voltage of about 1 volt or more, such as about 5 volts or more, such as about 10 volts or more, such as about 15 volts or more, such as about 20 volts or more, such as about 25 volts or more, such as about 50 volts or more, such as about 75 volts or more, such as about 100 volts or more. Such breakdown voltage may be realized at −55° C., such as at −25° C., such as at 0° C., such as at 25° C., such as at 50° C., such as at 75° C., such as at 100° C., such as at 125° C., such as at 150° C., such as at 175° C., such as at 200° C. For instance, such breakdown voltage may be realized at a temperature of from 50° C. to 200° C., such as from 150° C. to 200° C., such as from 175° C. to 200° C.

In general, the varistor may also exhibit a low capacitance. For example, the varistor may have a capacitance of about 0.1 pF or more, such as about 1 pF or more, such as about 5 pF or more, such as about 10 pF or more, such as about 25 pF or more, such as about 50 pF or more, such as about 100 pF or more, such as about 200 pF or more, such as about 250 pF or more, such as about 300 pF or more, such as about 400 pF or more, such as about 450 pF or more, such as about 500 pF or more, such as about 1,000 pF or more, such as about 5,000 pF or more, such as about 10,000 pF or more, such as about 25,000 pF or more. The varistor may have a capacitance of about 50,000 pF or less, such as about 40,000 pF or less, such as about 30,000 pF or less, such as about 20,000 pF or less, such as about 10,000 pF or less, such as about 5,000 pF or less, such as about 2,500 pF or less, such as about 1,000 pF or less, such as about 900 pF or less, such as about 800 pF or less, such as about 750 pF or less, such as about 700 pF or less, such as about 600 pF or less, such as about 550 pF or less, such as about 500 pF or less. Such capacitance may be realized at −55° C., such as at −25° C., such as at 0° C., such as at 25° C., such as at 50° C., such as at 75° C., such as at 100° C., such as at 125° C., such as at 150° C., such as at 175° C., such as at 200° C. For instance, such capacitance may be realized at a temperature of from 50° C. to 200° C., such as from 150° C. to 200° C., such as from 175° C. to 200° C.

Also, the varistor may exhibit a low leakage current. For example, the leakage current at an operating voltage of 18 volts may be about 1000 μA or less, such as about 500 μA or less, such as about 100 μA or less, such as about 50 μA or less, such as about 40 μA or less, such as about 30 μA or less, such as about 25 μA or less, such as about 20 μA or less, such as about 15 μA or less, such as about 10 μA or less, such as about 5 μA or less, such as about 4 μA or less, such as about 3 μA or less, such as about 2 μA or less, such as about 1 μA or less, such as about 0.8 μA or less, such as about 0.6 μA or less, such as about 0.5 μA or less, such as about 0.4 μA or less, such as about 0.3 μA or less, such as about 0.25 μA or less, such as about 0.2 μA or less, such as about 0.15 μA or less. The leakage current at an operating voltage of 18 volts may be more than 0 μA, such as about 0.001 μA or more, such as about 0.01 μA or more, such as about 0.05 μA or more, such as about 0.08 μA or more, such as about 0.1 μA or more, such as about 0.12 μA or more, such as about 0.15 μA or more, such as about 0.2 μA or more, such as about 0.25 μA or more, such as about 0.3 μA or more. Such leakage current may be realized at −55° C., such as at −25° C., such as at 0° C., such as at 25° C., such as at 50° C., such as at 75° C., such as at 100° C., such as at 125° C., such as at 150° C., such as at 175° C., such as at 200° C. For instance, such leakage current may be realized at a temperature of from 50° C. to 200° C., such as from 150° C. to 200° C., such as from 175° C. to 200° C.

Such leakage current may remain relatively low even after a certain number of hours as determined via a life test conducted at 150° C. and 18 volts (or 20 volts). For instance, the leakage current may be about 1000 μA or less, such as about 500 μA or less, such as about 100 μA or less, such as about 50 μA or less, such as about 40 μA or less, such as about 30 μA or less, such as about 25 pA or less, such as about 20 μA or less, such as about 15 μA or less, such as about 10 μA or less, such as about 5 μA or less, such as about 4 μA or less, such as about 3 μA or less, such as about 2 μA or less, such as about 1 μA or less, such as about 0.8 μA or less, such as about 0.6 μA or less, such as about 0.5 μA or less, such as about 0.4 μA or less, such as about 0.3 μA or less, such as about 0.25 μA or less, such as about 0.2 μA or less, such as about 0.15 μA or less even after 250 hours. The leakage current may be more than 0 μA, such as about 0.001 pA or more, such as about 0.01 μA or more, such as about 0.05 μA or more, such as about 0.08 μA or more, such as about 0.1 μA or more, such as about 0.12 μA or more, such as about 0.15 μA or more, such as about 0.2 μA or more, such as about 0.25 μA or more, such as about 0.3 μA or more even after 250 hours. In one embodiment, the varistor may exhibit such aforementioned values for leakage current even after 500 hours. In another embodiment, the varistor may exhibit such aforementioned values for leakage current even after at least 1000 hours, such as at least 1500 hours. In a further embodiment, the varistor may exhibit such aforementioned values for leakage current even after 2000 hours. Such leakage current may be realized at −55° C., such as at −25° C., such as at 0° C., such as at 25° C., such as at 50° C., such as at 75° C., such as at 100° C., such as at 125° C., such as at 150° C., such as at 175° C., such as at 200° C. For instance, such leakage current may be realized at a temperature of from 50° C. to 200° C., such as from 150° C. to 200° C., such as from 175° C. to 200° C.

In addition, the leakage current may actually be lower after a certain period of time compared to an initial leakage current. For instance, the leakage current after 2 hours, such as after 4 hours, such as after 6 hours, such as after 8 hours, such as after 10 hours, such as after 12 hours may be lower than the initial leakage current when measured at 150° C. and 18 volts. For instance, such leakage current may be at least 5%, such as at least 10%, such as at least 20%, such as at least 30%, such as at least 40%, such as at least 50%, such as at least 60%, such as at least 70% less than the initial leakage current.

Also, at higher temperatures, such as those mentioned above, the leakage current may be at least 30%, such as at least 40%, such as at least 50%, such as at least 60%, such as at least 70% less than the leakage current of a varistor including a dielectric material that does not include the disclosed positive temperature coefficient thermistor material and/or boron containing compound. For instance, as an example, a control varistor may exhibit a leakage current of about 4.6 μA at 150° C. while a varistor as disclosed herein may exhibit a leakage current of about 1.6 μA at 150° C. thus representing about a 65% reduction.

In general, the varistor may include a rectangular configuration defining first and second opposing end surfaces that are offset in a lengthwise direction. The varistor may include a first terminal adjacent the first opposing end surface and a second terminal adjacent the second opposing end surface. The varistor may also include an active electrode layer including a first electrode electrically connected with the first terminal and a second electrode electrically connected with the second terminal. The first electrode may be spaced apart from the second electrode in the lengthwise direction to form an active electrode end gap. The varistor may include a floating electrode layer comprising a floating electrode. The floating electrode layer may be spaced apart from the active electrode layer in a height-wise direction to form a floating electrode gap.

The varistor may include a plurality of alternating dielectric layers, and each layer may include an electrode. The dielectric layers may be pressed together and sintered to form a unitary structure. The dielectric layers may include any suitable dielectric material, such as, for instance, barium titanate, zinc oxide, or any other suitable dielectric material.

In one particular embodiment, the dielectric material may be made from zinc oxide. In this regard, zinc oxide may constitute the majority of the dielectric material. For instance, the zinc oxide may be present in an amount of more than 50 wt. %, such as about 60 wt. % or more, such as about 70 wt. % or more, such as about 80 wt. % or more, such as about 85 wt. % or more based on the weight of the dielectric material. The zinc oxide may be present in an amount of less than 100 wt. %, such as about 95 wt. % or less, such as about 90 wt. % or less, such as about 87 wt. % or less based on the weight of the dielectric material. Similarly, the zinc oxide may be present in an amount of more than 50 mol %, such as about 60 mol % or more, such as about 70 mol % or more, such as about 80 mol % or more, such as about 90 mol % or more, such as about 93 mol % or more, such as about 95 mol % or more of the dielectric material. The zinc oxide may be present in an amount of less than 100 mol %, such as about 99 mol % or less, such as about 98 mol % or less, such as about 97 mol % or less, such as about 96 mol % or less of the dielectric material.

Various additives may be included in the dielectric material, for example, that produce or enhance the voltage-dependent resistance of the dielectric material. For example, in some embodiments, the additives may include a metal oxide, a metal salt of an acid, or a combination thereof. In one embodiment, the additives may include a metal oxide, such as an oxide of cobalt, antimony, bismuth, manganese, nickel, gallium, aluminum, chromium, titanium, lead, barium, vanadium, tin, or a combination thereof. In one embodiment, the additives may include oxides of antimony, cobalt, nickel, chromium, bismuth, or any combination thereof. The additives may also include metal salts of an acid such as a metal carbonate, a metal nitrate, etc., or a combination thereof. Such metals may include cobalt, antimony, bismuth, manganese, nickel, gallium, aluminum, chromium, titanium, lead, barium, vanadium, tin, or a combination thereof. In this regard, in one embodiment, the additives may include manganese carbonate, aluminum nitrate, or a combination thereof. In one particular embodiment, the additives may include the aforementioned metal oxide and metal salt of an acid.

Such additives may be present, individually or in combination, in the dielectric material in an amount of about 0.001 wt. % or more, such as about 0.01 wt. % or more, such as about 0.02 wt. % or more, such as about 0.05 wt. % or more, such as about 0.1 wt. % or more, such as about 0.2 wt. % or more, such as about 0.5 wt. % or more, such as about 1 wt. % or more, such as about 2 wt. % or more, such as about 3 wt. % or more, such as about 5 wt. % or more based on the weight of the dielectric material. Such additives may be present, individually or in combination, in the dielectric material in an amount of 15 wt. % or less, such as about 10 wt. % or less, such as about 9 wt. % or less, such as about 8 wt. % or less, such as about 5 wt. % or less, such as about 3 wt. % or less, such as about 2 wt. % or less, such as about 1 wt. % or less, such as about 0.5 wt. % or less based on the weight of the dielectric material.

Such additives may be present, individually or in combination, in the dielectric material in an amount of about 0.001 mol % or more, such as about 0.01 mol % or more, such as about 0.02 mol % or more, such as about 0.05 mol % or more, such as about 0.1 mol % or more, such as about 0.2 mol % or more, such as about 0.4 mol % or more, such as about 0.5 mol % or more, such as about 0.8 mol % or more, such as about 1 mol % or more, such as about 1.2 mol % or more, such as about 1.4 mol % or more, such as about 1.5 mol % or more of the dielectric material. Such additives may be present, individually or in combination, in the dielectric material in an amount of less than 10 mol %, such as about 8 mol % or less, such as about 5 mol % or less, such as about 3 mol % or less, such as about 2 mol % or less, such as about 1.8 mol % or less, such as about 1.6 mol % or less, such as about 1.3 mol % or less, such as about 1 mol % or less, such as about 0.8 mol % or less, such as about 0.6 mol % or less, such as about 0.5 mol % or less, such as about 0.3 mol % or less, such as about 0.2 mol % or less, such as about 0.1 mol % or less of the dielectric material.

In general, the dielectric material, upon sintering, can include grains of zinc oxide separated by a grain boundary layer. Typically, the grain boundary layer is made of a negative temperature coefficient thermistor material whose resistance reduces with rising temperature and as the temperature increases, the materials of the grain boundary layer become more mobile. This, may lead to a decrease in breakdown voltage or resistance or an increased in leakage current. To counteract such effects, the dielectric material may include a positive temperature coefficient thermistor material. In general, when the operating temperature of the varistor rises, the positive temperature coefficient thermistor material has its resistance sharply increased so as to at least partially compensate for the reduced resistance of the negative temperature coefficient thermistor materials, in particular in the grain boundary layer, taken away by the reduced temperature. Such shift prevents the varistor from having an increased leakage current and decreased breakdown voltage. In this regard, positive temperature coefficient materials generally exhibit an increase in resistance with increasing temperatures.

The positive temperature coefficient thermistor material may be any type of such material generally known in the art. For instance, the positive temperature coefficient thermistor material may include a polycrystalline, a titanate, a metal oxide, or a mixture thereof.

In one embodiment, such material may be a polycrystalline. The polycrystalline material may be a ceramic. The polycrystalline may be an oxyalate, a carbonate, or a mixture thereof. In one embodiment, such material may be a carbonate. The carbonate may be an alkali metal carbonate, alkaline earth metal carbonate, a transition metal carbonate, a rare earth metal carbonate, or a mixture thereof. For instance, the alkali metal may be lithium, sodium, potassium or a mixture thereof. The alkaline earth metal may be beryllium, magnesium, calcium; strontium, barium, or a mixture thereof. The transition metal may be V, Cr, Mn, Fe, Co; Ni, Al, Ri, Zr, Sn, Nb, W; or a mixture thereof. The rare earth metal may be Ce, Dy, Er, Eu, Gd, Ho, La, Lu Nd, Pr, Pm, Sm, Sc, Tb, Y, Yb, or a mixture thereof.

In one embodiment, the carbonate may be an alkali metal carbonate. In another embodiment, the carbonate may be an alkaline earth metal carbonate. For instance, the alkaline earth metal carbonate may be magnesium carbonate, calcium carbonate, strontium carbonate; barium carbonate; or a mixture thereof. In one particular embodiment, such material may be a calcium carbonate. In a further embodiment, the carbonate may be a transition metal carbonate. For instance, the transition metal carbonate may be a manganese carbonate.

In another embodiment, such material may be a titanate. For instance, the titanate may have the general formula $ABO_3$ wherein A is metal and B is Ti. The metal is not necessarily limited and may be any metal employed in the art. For instance, the metal may be an alkali metal, an alkaline earth metal; a transition metal, or a rare-earth metal. For instance, the alkali metal may be lithium; sodium, potassium; or a mixture thereof. The alkaline earth metal may be beryllium, magnesium, calcium, strontium, barium, or a mixture thereof. The transition metal may be V. Cr, Mn, Fe, Co, Ni, AI, Ri, Zr, Sn, Nb, W, or a mixture thereof. The rare earth metal may be Ce, Dy, Er; Eu, Gd, Ho, La, Lu, Nd, Pr, Pm, Sm, Sc, Tb, Tm, Y. Yb, or a mixture thereof.

In one embodiment, A may be Ba such that the titanate is barium titanate. In another embodiment; A may be Sr such that the titanate is strontium titanate. In this regard, the titanate may be a barium titanate, a strontium titanate, or a combination thereof. In one embodiment, the titanate may be a barium titanate. In particular, the barium titanate may be a vitrescent barium titanate. In another embodiment, such material may be a barium titanate-doped strontium titanate.

In addition, it should be understood that more than one titanate may be employed in the material. While barium titanate and strontium titanate are expressly mentioned, it should be understood that other titanates may also be employed. For instance, these may include, but are not limited to lead titanate or calcium titanate. In this regard, it should be understood that the titanate may be any combination of the titanates as mentioned herein.

When the titanate includes a combination of titanates wherein at least one of the titanates is barium titanate, the barium titanate may be present in an amount of at least 50 mol. %, such as at least 60 mol. %, such as at least 70 mol. %, such as at least 80 mol. %, such as at least 90 mol. %, such as at least 95 mol. %, such as at least 98 mol. %, such as at least 99 mol. %, such as at least 99.9 mol. % based on the total amount of all of the titanates.

In another embodiment, such material may be a metal oxide. The metal may be any metal as generally known in the art. For instance, the metal may be an alkali metal, an alkaline earth metal, a transition metal, or a rare-earth metal. For instance, the alkali metal may be lithium, sodium, potassium, or a mixture thereof. The alkaline earth metal may be beryllium, magnesium, calcium, strontium, barium, or a mixture thereof. The transition metal may be V, Cr, Mn, Fe, Co, Ni, Al, Ri, Zr, Sn, Nb, W, or a mixture thereof. The rare earth metal may be Ce, Dy, Er, Eu, Gd, Ho, La, Lu, Nd, Pr, Pm, Sm, Sc, Tb, Tm, Y, Yb, or a mixture thereof.

In one particular embodiment, the metal oxide may be a rare earth metal oxide. For instance, the rare earth metal oxide may be a lanthanum oxide.

Such positive temperature coefficient material may be present in the dielectric material in the amounts as mentioned of the aforementioned additives, for instance the metal oxides and metal salts of the acids.

The positive temperature coefficient thermistor material may be present within the grain boundary layer at a certain concentration. In particular, such material may be present within the grain boundary layer in an amount of less than 10 mol %, such as about 8 mol % or less, such as about 6 mol % or less, such as about 5 mol % or less, such as about 3 mol % or less, such as about 2 mol % or less, such as about 1 mol % or less, such as about 0.8 mol % or less, such as about 0.6 mol % or less, such as about 0.4 mol % or less, such as about 0.3 mol % or less, such as about 0.2 mol % or less. The material may be present within the grain boundary layer in an amount of more than 0 mol %, such as about 0.001 mol % or more, such as about 0.005 mol % or more, such as about 0.01 mol % or more, such as about 0.02 mol % or more, such as about 0.05 mol % or more, such as about 0.1 mol % or more, such as about 0.15 mol % or more, such as about 0.2 mol % or more, such as about 0.25 mol % or more, such as about 0.3 mol % or more, such as about 0.5 mol % or more, such as about 1 mol % or more, such as about 2 mol % or more, such as about 3 mol % or more, such as about 4 mol % or more.

In addition to the polycrystalline, titanate, metal oxide, or mixture thereof, the material may further comprise a semiconducting additive. For instance, in one embodiment, such additive may allow for semiconductor transformation and adjustment of the Curie point (or the Curie temperature). Such additive may be a metal comprising Li, Ca, Mg, Sr, Ba, Sn, Mn, Si, Zr, Nb, Nd, Sb, Sm, Bi, Ce, Pb, Si, Sc, Er, Sn, Pr, Pm, Eu, Gd, Tb, Dy, Y, Yb, Ho, Tm, Lu, La, or a mixture thereof. In one embodiment, such additive may be a rare earth metal. For instance, such rare earth metal may be Ce, Dy, Er, Eu, Gd, Ho, La, Lu, Nd, Pr, Pm, Sm, Sc, Tb, Tm, Y, Yb, or a mixture thereof. In one embodiment, such metal may include Sm, Pb, Nd, La, or a mixture thereof. For instance, in one particular embodiment, the metal may include at least Sm. In another particular embodiment, the metal may include at least La.

Such additive may be present in an amount of from 0.001 mol % or more, such as 0.01 mol. % or more, such as 0.05 mol. % or more, such as 0.1 mol. % more to 2 mol. % or less, such as 1 mol. % or less, such as 0.8 mol. % or less, such as 0.5 mol. % or less based on the amount of the positive temperature coefficient thermistor material. In one embodiment, when the positive temperature coefficient thermistor material is a titanate, the aforementioned mol. % may be based on the amount of titanium present in the titanate.

In addition, the average grain size of the dielectric material may contribute to the non-linear properties of the dielectric material. In some embodiments, the average grain size may be about 1 micron or more, such as about 2 microns or more, such as about 5 microns or more, such as about 10 microns or more, such as about 20 microns or more. The average grain size may be about 100 microns or less, such as about 80 microns or less, such as about 50 microns or less, such as about 40 microns or less, such as about 25 microns or less, such as about 20 microns or less, such as about 10 microns or less.

In addition to the above, the dielectric material may also include a boron containing compound. For instance, the boron containing compound may include a boron containing acid. In one embodiment, such boron containing acid may include a boric acid, a boronic acid, or a combination thereof. In one particular embodiment, such boron containing compound may include a boric acid. The present invention also includes derivatives of such compounds as well as substituent groups at various positions.

Figure 3A:
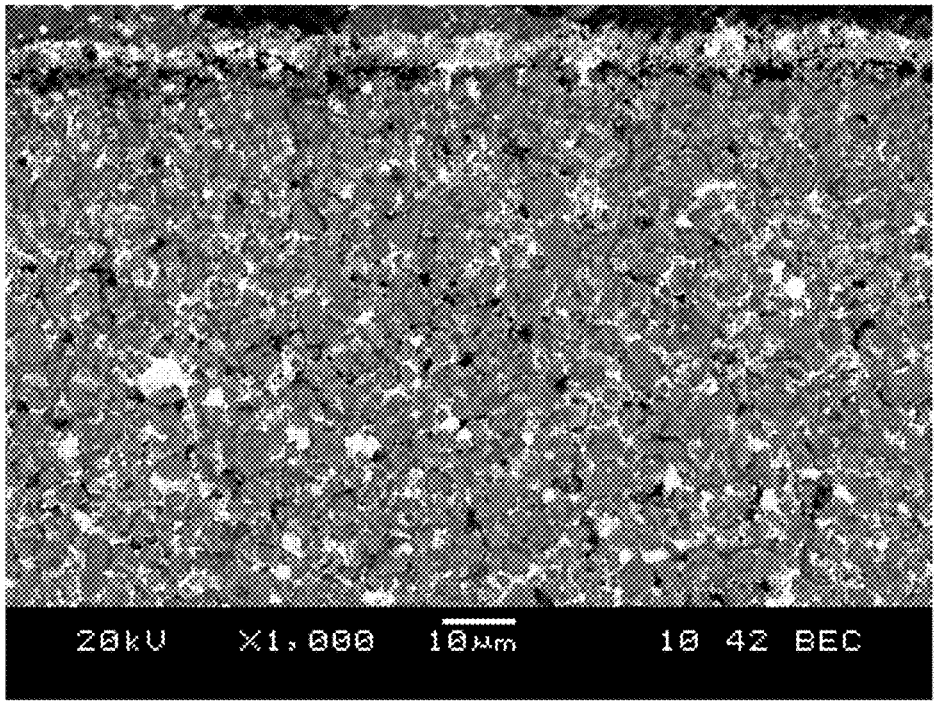
FIGS. 3A and 3B are scanning electron micrographs of cross sections of a dielectric material in accordance with aspects of the present disclosure.
Figure 3B:
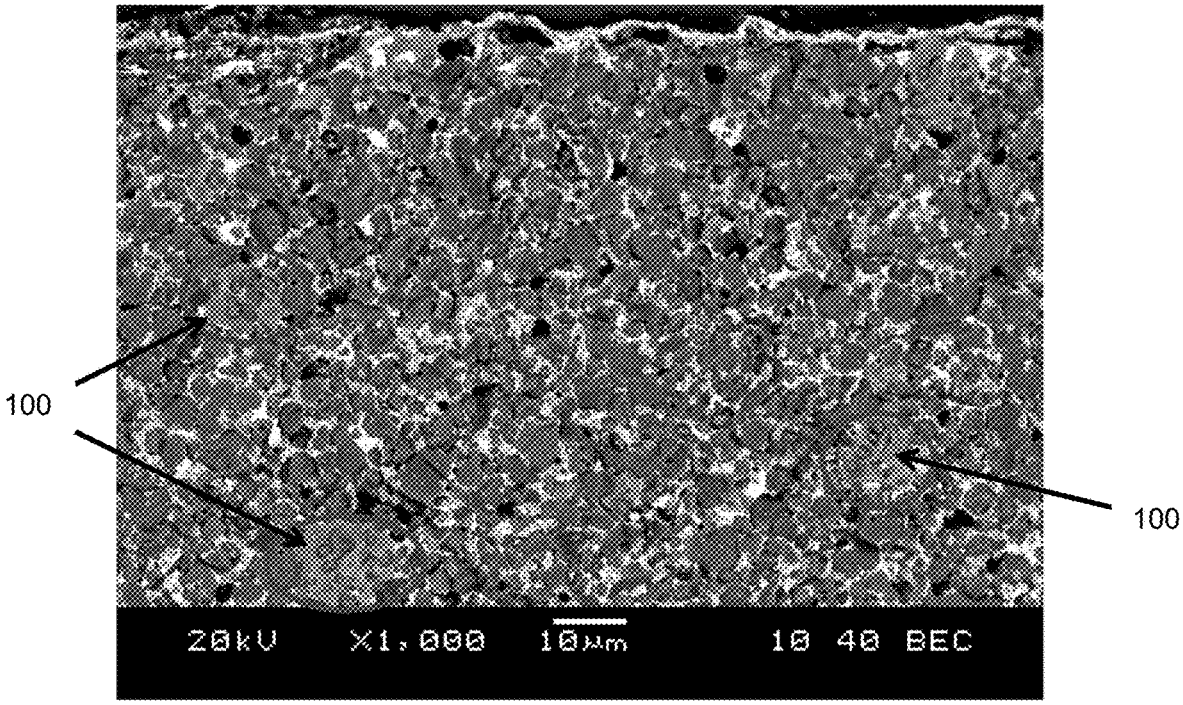
Figure 4:
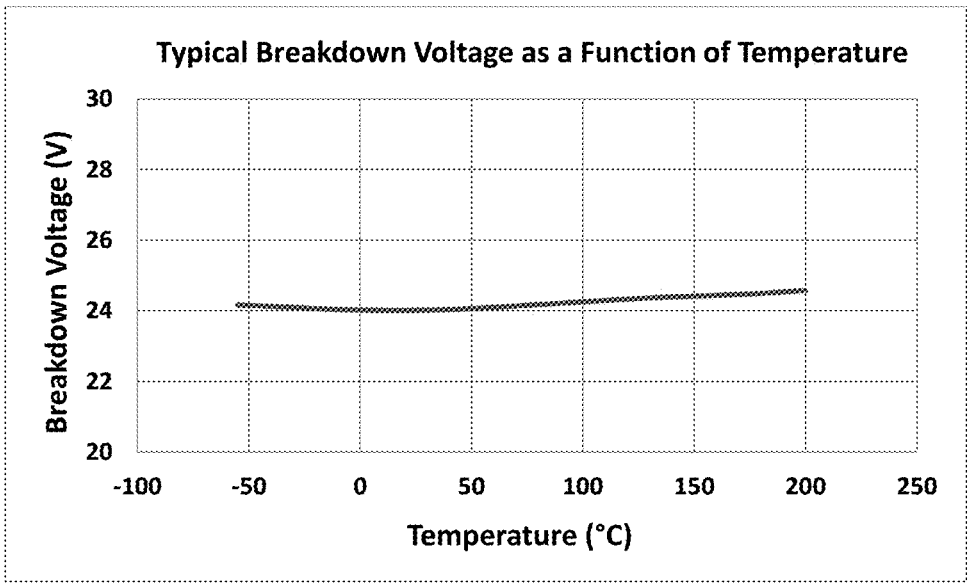
FIG. 4 illustrates the breakdown voltage as a function of temperature of a varistors according to Sample No. 1 of the examples.
Figure 5:
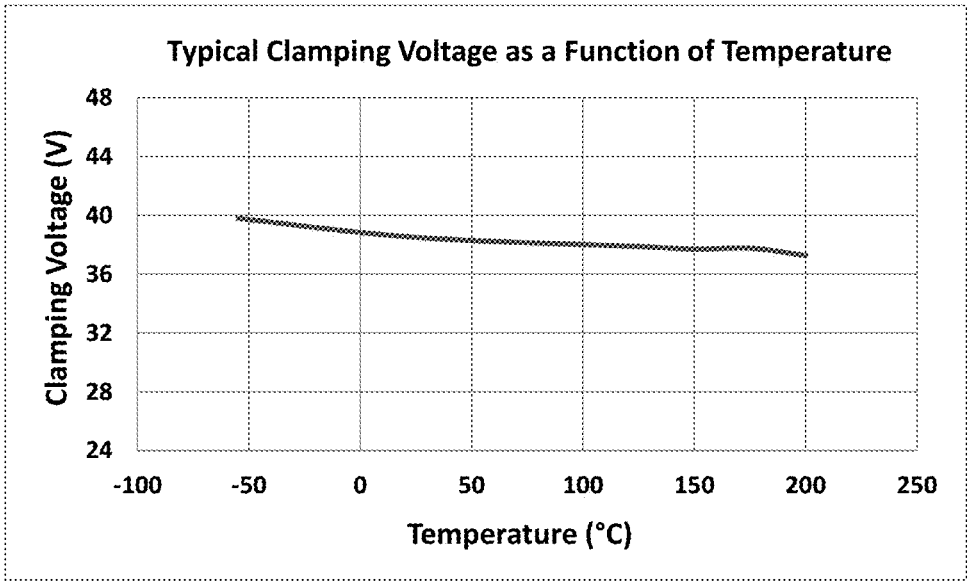
FIG. 5 illustrates the clamping voltage as a function of temperature of a varistors according to Sample No. 1 of the examples.
Figure 6:
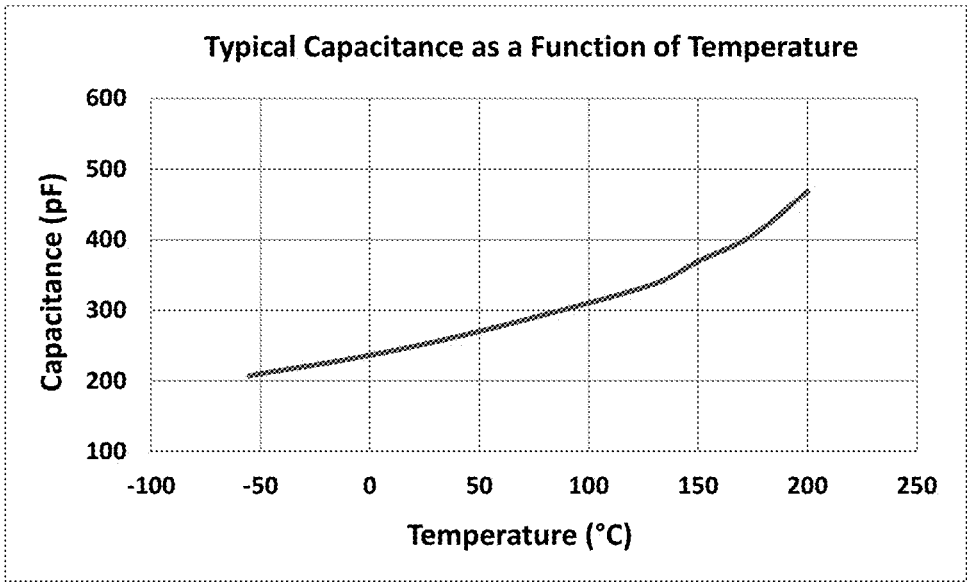
FIG. 6 illustrates the capacitance as a function of temperature of a varistors according to Sample No. 1 of the examples.
Figure 7:
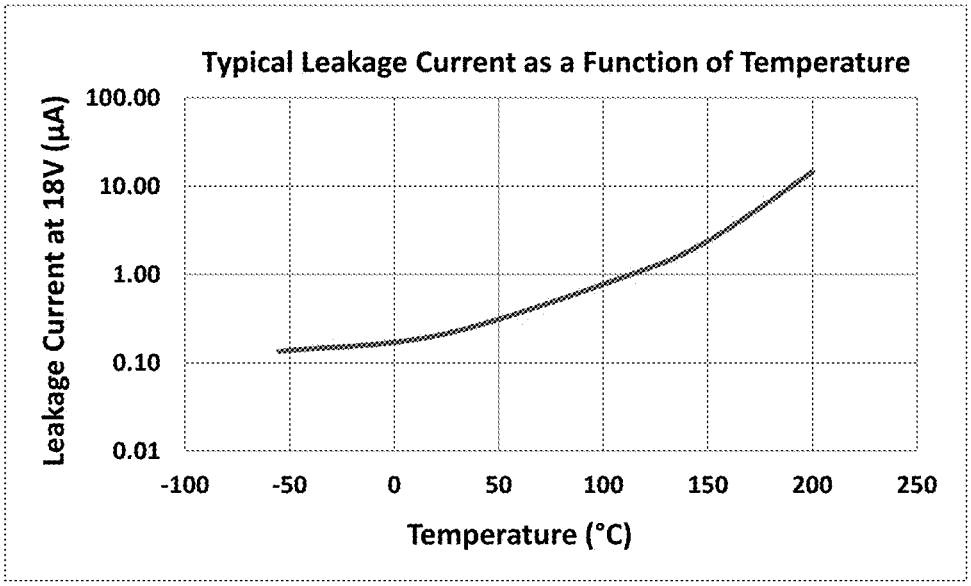
FIG. 7 illustrates the leakage current as a function of temperature of a varistors according to Sample No. 1 of the examples.

The present inventors have discovered that such boron containing compound may form an island within the dielectric. For instance, the island may block current from passing through the continuous glassy phase, such as a bismuth containing continuous glassy phase. Such islands are described and illustrated with respect to FIGS. 3A and 3B. FIG. 3A is a scanning electron micrograph of a surface fracture wherein the dielectric material does not include a boron containing compound and an island is not observed. Meanwhile, FIG. 3B is a scanning electron micrograph of a surface fracture wherein the dielectric material does include a boron containing compound, in particular boric acid, and an island is observed. With the boric acid, in FIG. 3B, islands 100 are present within the dielectric. Without intending to be limited by theory, such boron containing compound may allow for a disconnect of the electrical conductivity between grains and may also assist in defining better grain boundaries and/or stabilizing grain boundaries.

Such boron containing compound may be present in the dielectric material in an amount of about 0.01 wt. % or more, such as about 0.1 wt. % or more, such as about 0.2 wt. % or more, such as about 0.3 wt. % or more, such as about 0.5 wt. % or more, such as about 0.6 wt. % or more based on the weight of the dielectric material. Such boron containing compound may be present in the dielectric material in an amount of about 5 wt. % or less, such as about 3 wt. % or less, such as about 2 wt. % or less, such as about 1 wt. % or less, such as about 0.6 wt. % or less, such as about 0.5 wt. % or less based on the weight of the dielectric material.

The dielectric material can be produced using various methods. One method for forming the dielectric material can include first combining and/or calcining (e.g., at 1050° C.) zinc oxide with other additives, such as the aforementioned metal oxides and metal salts of acids. For instance, zinc oxide may be combined and calcined initially with antimony oxide, cobalt oxide, nickel oxide, chromium oxide, manganese carbonate, aluminum nitrate, and silica. Thereafter, the calcined zinc oxide may be mixed with other components. For instance, the calcined zinc oxide may be mixed with other oxides such as a bismuth oxide, a positive temperature coefficient thermistor material, a boron containing compound, or a combination thereof. In this regard, other oxides, such as bismuth oxide, may not be introduced in the initial calcining step but may be introduced in the second mixing step. Similarly, the positive temperature coefficient thermistor material may not be introduced in the initial calcining step but may be introduced in the second mixing step. Also, the boron containing compound may not be introduced in the initial calcining step but may be introduced in the second mixing step. Without intending to be limited by theory, the present inventors have discovered that such method can allow for a bismuth oxide to melt and the positive temperature coefficient thermistor material, such as barium titanate, to react with the calcined zinc oxide and such process can allow for a low leakage current.

Furthermore, it should be understood that the particular configuration of the varistor is not limited by the present invention. For instance, the configuration of the dielectric layers and electrodes is not limited by the present invention such that any configuration may be employed. In general, the varistor may include alternating first layers and second layers wherein each first layer may include a first electrode connected with a first terminal and each second layer may include a second electrode connected with a second terminal. The electrodes may be formed from a conductor such as palladium, silver, platinum, copper, or another suitable conductor capable of being printed on the dielectric layer. The varistor may include a top dielectric layer and a bottom dielectric layer and one or more of the top and bottom dielectric layers may include dummy electrodes.

In addition, it should be understood that the present invention is not limited to any particular number of dielectric-electrode layers. For instance, in some embodiments, the varistor may include 2 or more dielectric-electrode layers, 4 or more dielectric-electrode layers, 8 or more dielectric-electrode layers, 10 or more dielectric-electrode layers, 20 or more dielectric-electrode layers, 30 or more dielectric-electrode layers, or any suitable number of dielectric-electrode layers.

As indicated above, the varistor includes at least two external terminals wherein a first terminal is disposed on a first end surface of the varistor and a second terminal is disposed on a second end surface of the varistor, wherein the second end surface is opposite the first end surface. The terminals may include a metallization layer of platinum, copper, palladium, silver, or other suitable conductor material. A chromium/nickel layer, followed by a silver/lead layer, applied by typical processing techniques such as sputtering, can be used as an outer conductive layer for the termination structures.

The varistor disclosed herein may find applications in a wide variety of devices. For example, the varistor may be used in radio frequency antenna/amplifier circuits. The varistor may also find application in various technologies including laser drivers, sensors, radars, radio frequency identification chips, near field communication, data lines, Bluetooth, optics, Ethernet, and in any suitable circuit.

The varistor disclosed herein may also find particular application in the automotive industry. For example, the varistor may be used in any of the above-described circuits in automotive applications. For such applications, passive electrical components may be required to meet stringent durability and/or performance requirements. For example, AEC-Q200 standards regulate certain automotive applications. A varistor according to aspects of the present disclosure may be capable of satisfying one or more AEC-Q200 tests, including for example, a AEC-Q200-002 pulse test.

Ultra-low capacitance varistors may find particular application in data processing and transmission technologies. For example, aspects of the present disclosure are directed to varistors exhibiting capacitance less than about 1 pF. Such varistors may contribute minimal signal distortion in high frequency data transmission circuits, for example.

The present invention may be better understood with reference to the following example.

EXAMPLES

Test Methods

The following sections provide example methods for testing varistors to determine various varistor characteristics.

Clamping and Breakdown Voltage:

The clamping voltage of the varistor may be measured using a Frothingham Electronic Corporation FEC CV400 Unit. Referring again to FIG. 2, the clamping voltage 308 may be accurately measured as the maximum voltage measured across the varistor during a 8×20 μs current pulse, in which the rise time is 8 μs, and the decay time is 20 μs. This remains true as long as the peak current value 310 is not so great that it damages the varistor.

The breakdown voltage 306 may be detected at as the inflection point in the current vs. voltage relationship of the varistor. Referring to FIG. 2, for voltages greater than breakdown voltage 306, the current may increase more rapidly with increasing voltage compared with voltages that are less than the breakdown voltage 306. For example, FIG. 2 represents a log-log plot of current against voltage. For voltages less than the breakdown voltage 306, an ideal varistor may generally exhibit voltages approximately according to the following relationship:

$$V=CI^{\beta}$$

where V represents voltage; I represents current; and C and β are constants that depend on the specifics of the varistor (e.g., material properties). For varistors, the constant β is generally less than 1 such that the voltage increases less rapidly than an ideal resistor according to Ohm's law in this region.

For voltages greater than the breakdown voltage 306, however, the current vs. voltage relationship may generally approximately follow Ohm's law, in which current is linearly related with voltage:

$$V=IR$$

in which, V represents voltage; I represents current; and R is a large constant resistance value. The current vs voltage relationship may be measured as described above, and any suitable algorithm may be used to determine the inflection point in the empirically collected current vs. voltage data set.

Capacitance: The capacitance of the supercapacitors may be measured using a Keithley 3330 Precision LCZ meter with a DC bias of 0.0 volts, 1.1 volts, or 2.1 volts (0.5 volt root-mean-squared sinusoidal signal). The operating frequency is 1,000 Hz, unless otherwise specified. The relative humidity is 25%.

Example 1

A varistor as defined herein was manufactured according to the specifications indicated below and in the following table. The breakdown voltage, clamping voltage, capacitance, and leakage current were determined at room temperature of 23° C.

| No. | Zinc Oxide Based Formulation with 7.5 wt. % Bismuth Oxide | Mole (%) PTC | Breakdown Voltage (V) | Clamping Voltage (V) | Capacitance (pF) | Leakage Current at 18 V (μA) |
|---|---|---|---|---|---|---|
| 1 | 0.5 wt. % $BaTiO_3$ | 0.20 $BaTiO_3$ | 25.7 | 36.9 | 481 | 0.21 |
| 2 | 1.0 wt. % $BaTiO_3$ | 0.39 $BaTiO_3$ | 26.5 | 38.1 | 527 | 0.40 |
| 3 | 0.2 wt. % $CaCO_3$ | 0.18 $CaCO_3$ | 25.8 | 37.8 | 442 | 0.14 |
| 4 | 0.4 wt. % $CaCO_3$ | 0.36 $CaCO_3$ | 24.8 | 35.5 | 430 | 0.15 |
| 5 | 0.8 wt. % $CaCO_3$ | 0.73 $CaCO_3$ | 25.1 | 35.8 | 527 | 0.19 |
| 6 | 0.08 wt. % $La_2O_3$ | 0.02 $La_2O_3$ | 26.2 | 36.9 | 480 | 0.19 |

In addition to room temperature, Sample No. 1 was tested at additional temperatures. For instance, Sample No. 1 was tested at −55° C., 25° C., 125° C., 150° C., 175° C., and 200° C. The values for the breakdown voltage, clamping voltage, capacitance, and leakage current are illustrated in FIGS. 4-7, respectively.

These and other modifications and variations of the present invention may be practiced by those of ordinary skill in the art, without departing from the spirit and scope of the present invention. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A varistor comprising:

alternating dielectric layers and electrode layers, wherein the electrode layers include a first active electrode electrically connected to a first external terminal and a second active electrode electrically connected to a second external terminal, wherein the dielectric layers include a dielectric material comprising a sintered ceramic composed of zinc oxide grains and a grain boundary layer between the zinc oxide grains, wherein the grain boundary layer contains a positive temperature coefficient thermistor material in an amount of less than 10 mol % based on the grain boundary layer.

2. The varistor according to claim 1, wherein the grain boundary layer contains a positive temperature coefficient thermistor material in an amount of from 0.1 mol % to 8 mol % based on the grain boundary layer.

3. The varistor according to claim 1, wherein the grain boundary layer contains a positive temperature coefficient thermistor material in an amount of from 4 mol % to 6 mol % based on the grain boundary layer.

4. The varistor according to claim 1, wherein the positive temperature coefficient thermistor material includes a titanate.

5. The varistor according to claim 4, wherein the titanate includes a barium titanate.

6. The varistor according to claim 1, wherein the positive temperature coefficient thermistor material includes an alkaline earth metal carbonate.

7. The varistor according to claim 6, wherein the alkaline earth metal carbonate includes a calcium carbonate.

8. The varistor according to claim 1, wherein the positive temperature coefficient thermistor material includes a rare earth metal oxide.

9. The varistor according to claim 8, wherein the rare earth metal oxide includes a lanthanum oxide.

10. The varistor according to claim 1, wherein the dielectric material includes a boron containing compound.

11. The varistor according to claim 10, wherein the boron containing compound includes a boron acid.

12. The varistor according to claim 1, wherein the varistor has a maximum operating temperature of from greater than 125° C. to 300° C.

13. The varistor according to claim 1, wherein the varistor has a clamping voltage of from about 30 volts to about 75 volts at a temperature of 150° C.

14. The varistor according to claim 1, wherein the varistor has a breakdown voltage of from about 10 volts to about 50 volts at a temperature of 150° C.

15. The varistor according to claim 1, wherein the varistor has a breakdown voltage of 40 volts or less at a temperature of 150° C.

16. The varistor according to claim 1, wherein the varistor has a capacitance of from about 500 pF to about 20,000 pF at a temperature of 150° C.

17. The varistor according to claim 1, wherein the varistor exhibits a leakage current of 40 μA or less at a temperature of 150° C.

18. The varistor according to claim 1, wherein the varistor exhibits a leakage current of 25 μA or less at a temperature of 150° C.

19. The varistor according to claim 1, wherein the varistor exhibits a leakage current of 10 μA or less at a temperature of 150° C.

20. The varistor according to claim 1, wherein the varistor exhibits a leakage current of 5 μA or less at a temperature of 150° C.

21. The varistor according to claim 1, wherein the varistor exhibits a leakage current of 40 μA or less over a temperature of from 150° C. to 200° C.

* * * * *